US005927570A

United States Patent [19]

Beverly

[11] Patent Number: 5,927,570

[45] Date of Patent: Jul. 27, 1999

[54] COAT HANGER WITH GARMENT HOLDER

[76] Inventor: Keith Beverly, 352 Seadrift Rd., Stinson Beach, Calif. 94970

[21] Appl. No.: 09/105,126

[22] Filed: Jun. 24, 1998

[51] Int. Cl.[6] ..... A47G 25/18

[52] U.S. Cl. ..... 223/88; 223/85; 411/475; 411/469

[58] Field of Search ..... 223/88, 85, 92, 223/95; 411/475, 469; 403/298, 206

[56] References Cited

U.S. PATENT DOCUMENTS

| | | | |
|---|---|---|---|
| 980,219 | 1/1911 | Drucker | 223/88 |
| 1,262,280 | 4/1918 | Stoddard | 223/88 |
| 2,153,905 | 4/1939 | Yankovitch | 223/88 |
| 2,168,710 | 8/1939 | Johnson | 223/88 |
| 3,227,334 | 1/1966 | Samuelson | 223/85 |
| 3,295,873 | 1/1967 | Attwood | 403/206 |
| 5,529,424 | 6/1996 | Neubert | 403/298 |
| 5,603,586 | 2/1997 | Wetsel | 403/298 |
| 5,664,820 | 9/1997 | Carmien | 403/298 |

FOREIGN PATENT DOCUMENTS

| | | | |
|---|---|---|---|
| 249328 | 9/1966 | Austria | 411/475 |
| 328332 | 4/1958 | Switzerland | 411/475 |

OTHER PUBLICATIONS

Photo; Undated; Conventional Coat Hanger for Skirts or the Like.

*Primary Examiner*—Bibhu Mohanty
*Attorney, Agent, or Firm*—Oppenheimer Wolff & Donnelly LLP

[57] ABSTRACT

A hanger for hanging on a rod and holding clothes thereon. The hanger has a pair of spaced vertical downwardly extension portions forming a garment holder. The extension portions are secured to the hanger by angled ends fixed into the bottom of the hanger providing ends which can be quickly and easily forced into the hanger bottom and keep the garment holder from rotating with respect to the hanger.

4 Claims, 1 Drawing Sheet

FIG. 1
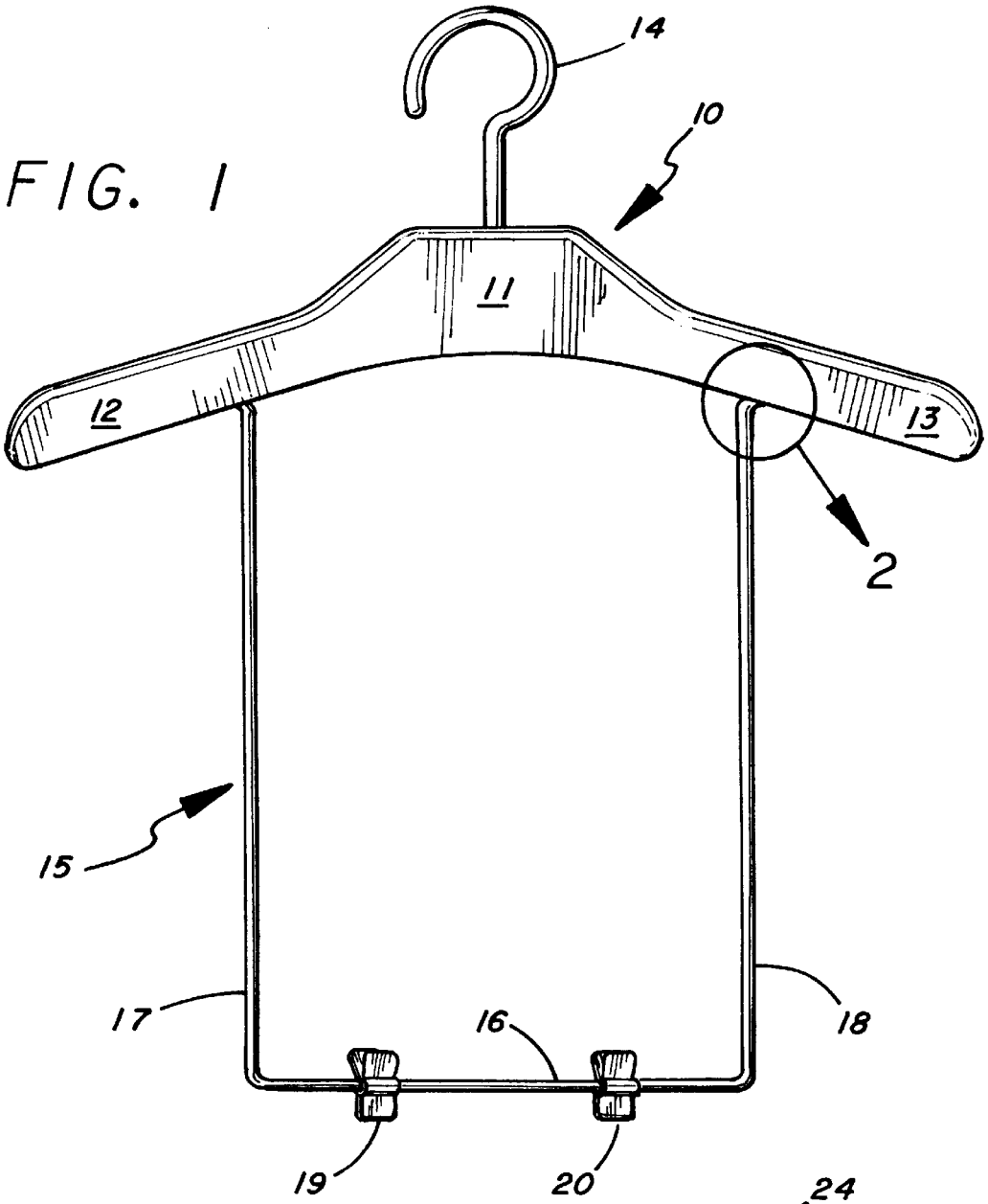
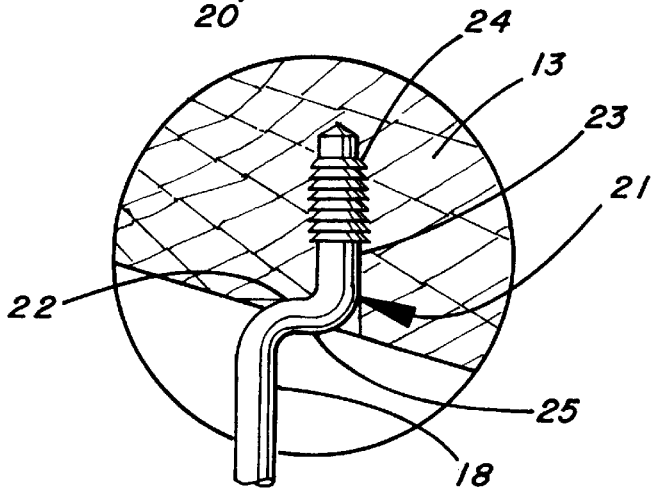
FIG. 2

COAT HANGER WITH GARMENT HOLDER

BACKGROUND OF THE INVENTION

1. Field of the Invention

The invention relates to coat hangers, and, more particularly, to a coat hanger having a downwardly extending garment holder.

2. Related Art

Coat hangers are well known in the art. Generally, such hangers are made from wood or plastic. Some hangers have a downwardly extending portion so the hanger can be hung from a closet rod or the like and other garments, such as pants or the like, may be hung from the extension portion. Wood hangers are more expensive than plastic hangers but look better and are considered more classier than plastic hangers. However, in the past it has been difficult to manufacture wood hangers having downwardly extending portions since it was impossible to fix the latter to the hanger in a firm, secure manner without considerable expense. There is a need for a hanger having a downwardly extending portion which can be fixed quickly and inexpensively to the hanger in a firm secure manner.

SUMMARY OF THE INVENTION

It is an object of this invention to provide an improved coat hanger having a downwardly extending garment holding portion fixedly secured thereto.

It is an object of this invention to carry out the foregoing object wherein the garment holding extension portion is quickly and easily fixed to the hanger in a firm, secure manner.

It is still another object of this invention to carry out the foregoing objects wherein the garment holding extension portion is fixed to the hanger in a manner preventing rotation of the garment holding extension portion with respect to the hanger.

These and other objects are preferably accomplished by providing a coat hanger for hanging in a closet and holding clothes having a pair of spaced vertical downwardly extending portions forming a holder. The extension portions are secured to the hanger by angled ends fixed into the bottom of the hanger providing ends which can be quickly and easily forced onto the hanger bottom and keep the garment holder from rotating with respect to the hanger.

BRIEF DESCRIPTION OF THE DRAWING

FIG. 1 is an elevational view of a coat hanger in accordance with the teachings of the invention; and FIG. 2 is a view taken along line 2 of FIG. 1 illustrating the inner connection of the garment holding extension to the hanger, the latter shown in cross-section.

DESCRIPTION OF THE PREFERRED EMBODIMENTS

Referring now to FIG. 1 of the drawing, a coat hanger 10 is shown preferably made of wood or of any other suitable material wherein a barbed instrument may extend and hold therein. Hanger 10 has a main body portion 11 with integral outwardly extending arms 12, 13 and a hook portion 14 at top.

As particularly contemplated in the present invention, a downwardly extending garment holder 15 is provided. Holder 15 is preferably U-shaped having a horizontally extending bottom portion 16 and a pair of spaced elongated vertically extending portions 17, 18 integral with portion 16. One or more conventional garment clamping clips, such as clips 19, 20, may be mounted on portion 16 and movable therealong to a desired position.

As particularly contemplated, each portion 17, 18 terminates at top in an angled portion, such as angled end 21 (FIG. 2). Each angled end 21 has a first portion 22 integral with portion 18 (or 17) extending outwardly at a slight angle with respect to the longitudinal axis of portion 18 (or the axis of portion 17), then upwardly as an integral portion 23. The longitudinal axis of portion 23 is generally parallel to the longitudinal axis of portion 18 and terminates in a barbed end 24.

Thus, the longitudinal axis of portion 22 may be at an angle of about 80° to 85° with respect to the longitudinal axis of portion 18. As seen in FIG. 1, portion 22 extends into the arm 13 of hanger 10. This is accomplished by the operator utilizing a specialized tool striking the underside 25 (FIG. 2) of angled end 21 forcing barbed end 24 up into the material, such as wood, of arm 13 of hanger 10. The final position of end 24 in arm 13 is shown in FIG. 2. Since part of the angled portion 23 extends into the arm 13 and part is outside of arm 13, garment holder 15 cannot rotate with respect to hanger 10. Thus, the angled ends 21 both assist in the driving of the barbed ends 24 of the spaced portions 17, 18 into the hanger 10 and prevent rotation of the garment hanger 15 with respect to coat hanger 10.

As discussed, wood is preferred for hanger 10 except for hook 14 (which may be of plastic or a metallic material). Wood receives the barbed end when driven or hammered in and the barbs retain the garment holder to the hanger when weight is placed on the garment holder. The garment holder may be made of any suitable rigid material but round metal wire is preferred.

Although a particular embodiment of the invention is disclosed, variations thereof may occur to an artisan and the scope of the invention should only be limited by the scope of the appended claims.

I claim:

1. A coat hanger having a main body portion with a pair of integral outwardly extending spaced arms, a hook connected to the main body portion extending upwardly therefrom, and a garment holder connected to said main body portion extending downwardly therefrom, and a garment holder being comprised of a linear generally horizontally extending bottom portion connected at each end to spaced integral upwardly extending vertical portions, each of said vertical portions having a central longitudinal axis and terminating at top in an angled end fixedly secured to said spaced arms, each of said angled ends of said garment holder includes a first angled portion integral with its respective vertical portion extending outwardly and away therefrom, and a second portion integral with said first angled portion having a central longitudinal axis spaced from the central longitudinal axis of its respective vertical portion and generally parallel thereto and said second portion extending upwardly from said first angled portion into its respective spaced arm terminating in a barbed end fixed in the material of said spaced arm, at least a portion of said angled portion and all of said barbed end fixedly embedded in its respective spaced arm whereby said barbed end cannot be easily pulled downwardly away from its respective spaced arm and out thereof.

2. The coat hanger of claim 1 wherein said first angled portion of said garment holder is at an angle of about 100° to 110° with respect to the longitudinal axis of said vertical portion.

3. The coat hanger of claim 1 wherein said hanger is of wood.

4. The coat hanger of claim 1 wherein said garment holder is of metallic wire having a generally circular cross-section.

* * * * *